United States Patent [19]

Hall

[11] 4,313,391

[45] Feb. 2, 1982

[54] MAST SHROUD SYSTEM

[75] Inventor: Eric R. D. Hall, Marion, Mass.

[73] Assignee: Schaefer Marine, Inc., New Bedford, Mass.

[21] Appl. No.: 115,217

[22] Filed: Jan. 25, 1980

[51] Int. Cl.[3] ..... F16B 1/00

[52] U.S. Cl. ..... 114/90

[58] Field of Search ..... 114/39, 102, 89, 90, 114/91, 92, 93, 94

[56] References Cited

U.S. PATENT DOCUMENTS

| | | | |
|---|---|---|---|
| 2,326,289 | 8/1943 | Deshong | 114/90 |
| 3,112,725 | 12/1963 | Malrose | 114/90 |
| 3,610,190 | 10/1971 | Palmer | 114/91 |
| 4,230,060 | 10/1980 | McCoy | 114/90 |

FOREIGN PATENT DOCUMENTS

| | | | |
|---|---|---|---|
| 443954 | 2/1968 | Fed. Rep. of Germany | 114/90 |
| 2236718 | 7/1975 | France | 114/89 |
| 1050918 | 1/1965 | United Kingdom | 114/90 |
| 2011332 | 7/1979 | United Kingdom | 114/90 |

*Primary Examiner*—Trygve M. Blix
*Assistant Examiner*—C. T. Bartz
*Attorney, Agent, or Firm*—Cesari and McKenna

[57] ABSTRACT

A mast shroud system includes a spreader-tang assembly composed of a rigid bracket extending entirely through the mast which functions as both a spreader root spigot and a tang for securing the terminated upper ends of shrouds to the mast. The shroud terminals are seated in pockets formed in the bracket and tubular spreaders are telescopically engaged over opposite ends of the bracket so that the spreaders lock the terminals in their respective pockets and conceal them while at the same time locking the bracket to the mast.

10 Claims, 4 Drawing Figures

MAST SHROUD SYSTEM

This invention relates to a mast shroud system for a sailboat. It relates more particularly to an improved spreader arrangement for positioning and securing the various shrouds which help to stiffen the mast or spar of a sailboat.

BACKGROUND OF THE INVENTION

In order to prevent or minimize the flexing of a boat mast when the boat is under sail, the boat is outfitted with so-called standing rigging. This includes a forestay and a backstay which extend from the head of the mast down to chain plates at the fore and aft ends of the boat. Also, sidestays or shrouds extend from the mast down to chain plates at the port and starboard sides of the boat to provide lateral stiffening. Invariably, the full length shrouds secured to the mast head are spaced away from the mast by laterally extending spreaders usually secured to the mast about one-half of the way up thereon so as to increase the angle which the shrouds make with the mast. Additional shrouds extend directly down to the hull from the mast near the points of attachment of the spreaders to further stiffen the mast.

Most conventionally, the upper ends of the shrouds are pinned to double or single leaf tangs or plates attached to the mast. It is time-consuming to connect the several such plates required to the mast and they offer considerable wind resistance. On other boats, the upper end of the shroud carries a terminal which engages in an opening of a tang anchored to the outside of the mast which fitting also serves as a spreader attachment device. Since a considerable tensile force is applied to the shroud, a substantial torque is developed at the root of the tang which causes bending and distortion of the mast wall in that area. Also, it is quite difficult to disconnect the shroud from the mast. The lower end of the shroud has to be detached from its turnbuckle and the entire shroud pulled up through the tang opening in order to separate the shroud from the mast. This can be a tedious process, bearing in mind that at least the larger boats have several such shrouds connected to the mast near the spreaders. Still other boats have internal shroud connections whereby the shroud terminates in a talurit soft eye which engages around a pin or spigot inside the mast. Such internal shroud connections are disadvantaged, however, because, openings must be provided in the mast to accommodate the shrouds and the upper ends of the shrouds lie close to the mast, both of which factors are undesirable from an aerodynamic standpoint. Also, here again, it is relatively difficult to disconnect the shrouds from the spar in the event that one wishes to paint the spar or store it away for the winter.

The aforesaid prior modes of connecting the upper ends of the shrouds to the spar also increase the initial cost of the spar because of the labor involved in making the required openings therein and effecting the required welds.

SUMMARY OF THE INVENTION

Accordingly, the present invention aims to provide a mast shroud system for a sailboat which facilitates the connection of the shrouds to the mast.

Another object of the invention is to provide a mast shroud system which is relatively inexpensive to make and install as compared with prior comparable arrangements of this general type.

Yet another object of the invention is to provide a mast shroud system which simplifies the procedure for connecting the shrouds to, and disconnecting them from, the mast.

Yet another object of the invention is to provide such a system wherein the spreaders cooperate to removably secure the shrouds to the mast.

Yet another object of the invention is to provide a mast shroud system which minimizes aerodynamic drag on the system components.

Yet another object of the invention is to provide a mast shroud system which imposes minimum bending stresses on the mast walls.

Other objects will, in part, be obvious and will, in part, appear hereinafter.

The invention accordingly comprises the features of construction, combination of elements, and arrangement of parts which will be exemplified in the following detailed description, and the scope of the invention will be indicated in the claims.

Briefly, in the present mast shroud system, the upper ends of the shrouds carry terminals which removably engage in keyholes formed in a bar which extends all the way through the mast and to which bar the spreaders are also anchored. Thus a single bar performs the dual functions of a shroud tang and a root spigot for the spreaders.

Preferably also, each terminal-receiving opening in the bar is formed with a contiguous recessed pocket for seating the terminal. Also, each spreader is telescopically engaged over an end of the bar so that it overlies the pocket and thereby locks the terminal to the bar. When both spreaders are in place, then, they maintain the lateral position of the shroud-supporting bar relative to the mast, they lock the shroud terminals to the bar, and they conceal the terminal connections which is desirable from aesthetic and aerodynamic standpoints.

To install the present system, one simply inserts the bar through aligned openings formed in the opposite walls of the mast. Then one pushes the shroud terminals up through their respective keyholes in the bar and seats them in their associated contiguous pockets. Finally, the spreaders are engaged over the ends of the bar projecting out laterally at opposite sides of the mast and secured thereto using appropriate threaded fasteners. When so installed, the spreaders are firmly affixed to the mast and the shroud terminals are locked in place in their respective pockets under the spreaders.

Conversely, when it is desired to disconnect the shrouds in order to paint the mast, for example, one simply has to remove the threaded fasteners, slide the spreaders from the bar, unhook the shroud terminals from their respective keyholes and slide the bar out of the mast. In this connection, it is not even necessary to disconnect the lower ends of the shrouds from their respective chain plates; merely detensioning them will provide sufficient slack to permit the terminals to be unhooked from the bar as described above.

Accordingly, the present arrangement simplifies both the initial installation of the shrouds and spreaders and also facilitates their removal for repair or replacement purposes in the event that becomes necessary. Accordingly, the system should find wide application in the boating industry.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
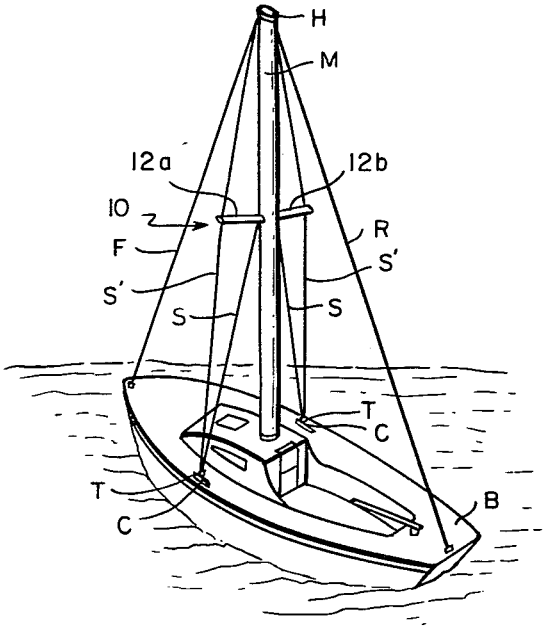
FIG. 1 is a perspective view of a sailboat employing a mast shroud system embodying the principles of this invention.

Turning first to FIG. 1 of the drawings, a boat B has a mast or spar M terminating in a head H. Positioned on mast M approximately three-fourths of the way up thereon is a spreader-tang assembly indicated generally at 10. Mast M is stiffened and placed under compression by a pair of shrouds S whose upper ends are connected to assembly 10 and whose lower ends are connected by way of turnbuckles T to chain plates C connected to the port and starboard sides of the boat hull. Assembly 10 includes a pair of spreaders 12*a* and 12*b* and additional shrouds S′ extend from the mast head H through the ends of the spreaders down to same or additional turnbuckles T and chain plates C secured to the port and starboard sides of the boat. The spreaders 12*a* and 12*b* thus increase the angle which the full length shrouds S′ make with the upper portion of the mast to achieve maximum stiffening of that portion. The standing rigging also includes the usual forestay F and backstay R extending from mast head H down to the fore and aft ends of the boat.

Figure 2:
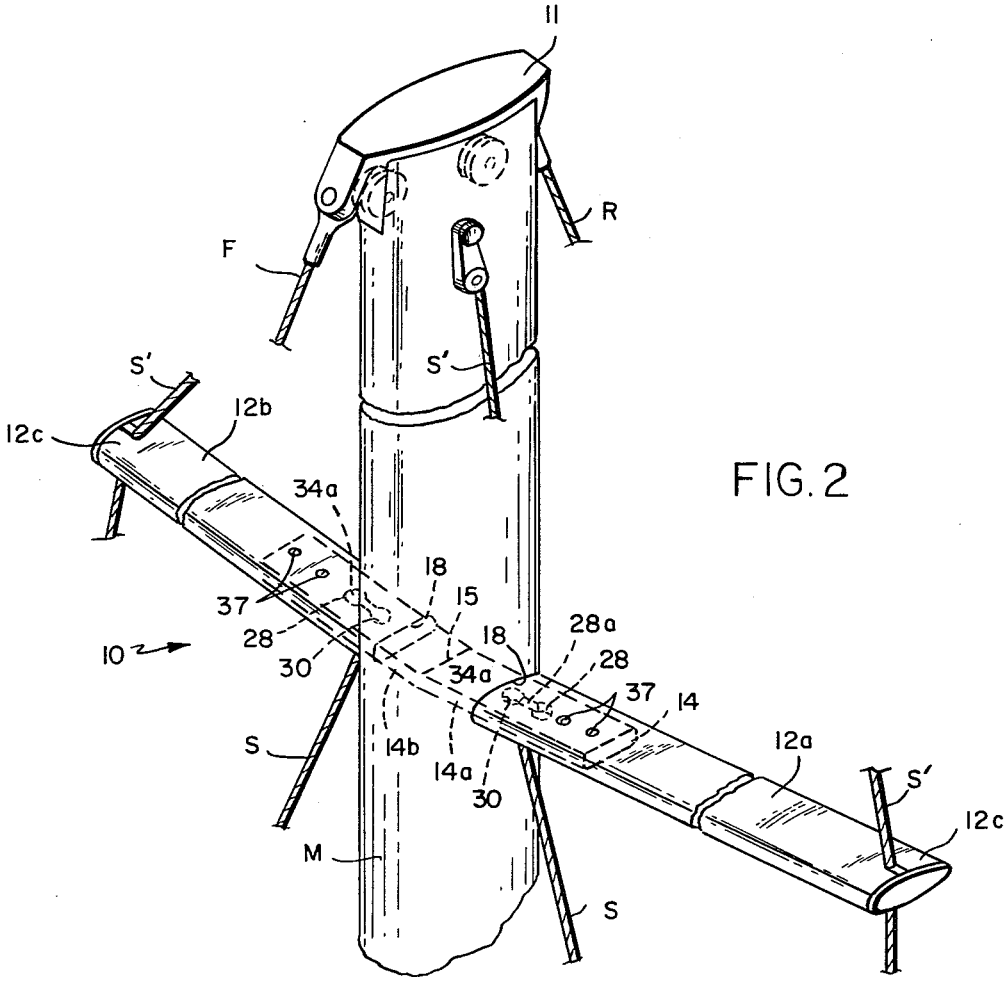
FIG. 2 is a fragmentary perspective view with parts broken away on a larger scale showing the FIG. 1 system in greater detail.
Figure 3:
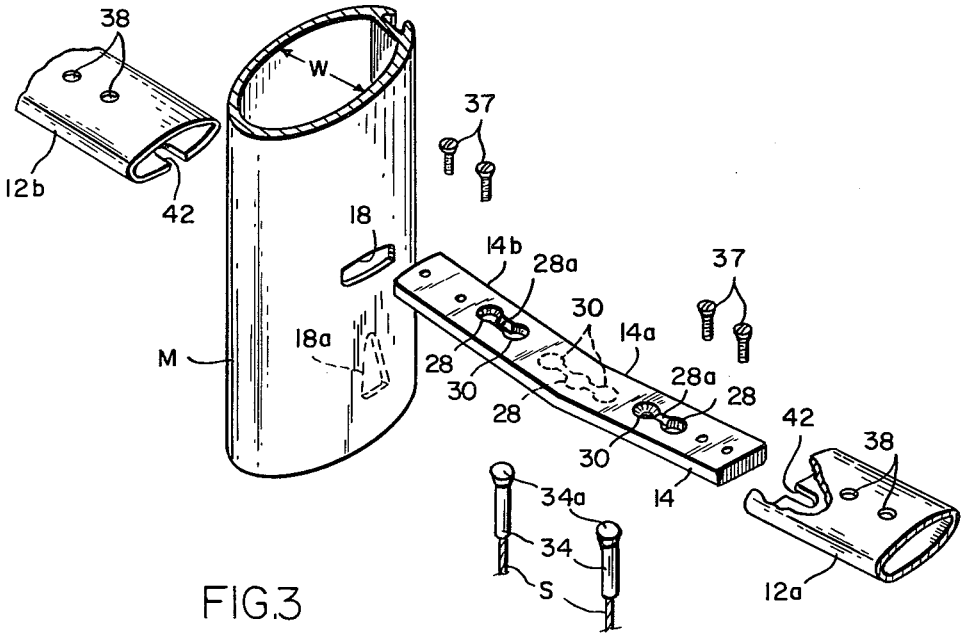
FIG. 3 is an exploded perspective view with parts broken away showing the system parts in their disassembled condition.

Referring now to FIGS. 2 and 3, the spreader-tang assembly 10 includes a rigid bracket 14 in the form of a generally rectangular steel bar. The bracket 14 is bent along its transverse center line 15 so that the two segments 14*a* and 14*b* on each side of center line 15 bend upwardly at an angle of, say, four degrees. Bracket 14 is arranged to be snugly received in a pair of aligned, generally rectangular openings 18 formed in the side walls of the mast M with the ends of the bracket projecting from opposite sides of the mast. Formed in bracket segments 14*a* and 14*b* are a pair of mirror-image keyholes 28. Preferably the keyholes are spaced apart from one another a distance exceeding the width W (FIG. 3) of mast M so that they are located outside the mast. The reduced-width necks 28*a* of the keyholes 28 extend toward one another along the longitudinal axis of bracket 14 and terminate in contiguous pockets 30.

As will be described presently, each keyhole-pocket 28, 30 pair constitutes a tang for retaining the upper end of a shroud S. Each shroud S is terminated by a terminal 34 having an enlarged head 34*a*. The terminal and its head are sized with respect to the keyhole 28 in bracket 14 so that the head can be inserted up through the enlarged end of the keyhole and be slid along the keyhole neck 28*a* to the associated pocket 30. Terminal head 34*a*, particularly its underside, is shaped and arranged so as to conform to its pocket 30. In the system embodiment illustrated, the terminal 34 is a modified ball-shaped terminal whose head 34*a* has a spherical undersurface and a top surface which is flat. Accordingly, the pocket 30 is formed so that its wall conforms to the spherical undersurface of the head 34*a* assuring that the tensile forces exerted on each shroud S will be distributed over the entire wall area of its pocket 30.

Of course, if the shroud S is terminated with another type of terminal such as simple ball terminal, a hook terminal, an eye or jaw terminal, the keyhole 28 and pocket 30 would be shaped accordingly to accept and seat the head of that particular type terminal.

The assembly 10 also includes the spreaders 12*a* and 12*b* which are mirror-image, airfoil-shaped tubular members arranged to telescopically engage over the projecting ends of bracket 14. When the two spreaders are slid into position over the ends of the bracket with their inboard ends abutting mast M as shown in FIG. 2, they completely cover and conceal the keyhole-pocket pairs 28, 30 formed in bracket 14. Moreover, they capture the terminals 34 in their respective pockets 30 so that the upper ends of the shrouds cannot be disengaged inadvertently from the bracket. As best seen in FIG. 3, a lateral notch 42 is formed in the lower wall of each spreader at the inboard end thereof to accommodate the shank of the associated terminal 34.

To maintain the proper positions of the spreaders on the bracket, threaded fasteners 37 are turned down through openings 38 formed in the upper walls of the spreaders and into mating threaded holes 40 formed in the top wall of bracket 14 near the outer ends thereof. When secured in this position, the spreaders 12*a* and 12*b* not only lock the terminals 34 in their respective pockets as described above, they also prevent lateral movement of the bracket 14 with respect to the mast M.

Once these spreaders 12*a* and 12*b* are secured in place, the full length spreaders S′ can be engaged to their outer ends 12*c* (FIG. 2) in the customary way.

Figure 4:
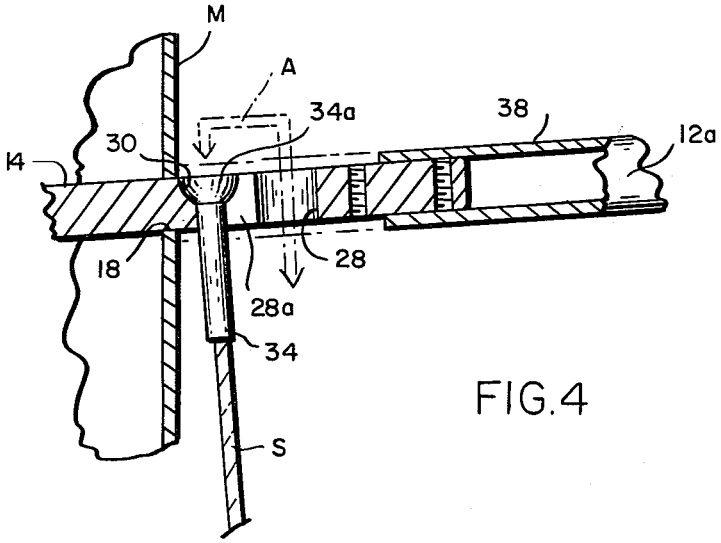
FIG. 4 is a fragmentary sectional view showing elements of the system in greater detail.

To install the system on boat B, the bracket 14 is first inserted through the openings 18 in the mast M. Then the teminals 34 at the upper ends of the shrouds S are inserted through their respective keyholes 28 from below, slide along necks 28*a* and seated in their respective pockets 30 as indicated by the heavy arrow A in FIG. 4. In this connection, it should be mentioned that since the bracket is upwardly angled about its transverse center line 15, the pockets 30 should be cocked or oriented so that when the shrouds S extend down to their points of connection to the boat hull, the terminal heads 34*a* will bottom or be centered in their respective pockets as best shown in FIG. 4.

Next, the spreaders 12*a* and 12*b* should be engaged over the exposed ends of the bracket with their inboard ends abutting the mast so as to completely conceal the shroud connections to the bracket and to positively lock the shroud terminals to the bracket and to fix the lateral position of the bracket with respect to the mast. Finally, the fasteners 37 are turned down into their respective threaded holes 40 to secure the spreaders to the bracket. Once the spreaders are locked in place, the shrouds S′ can be engaged about the outer ends of the spreaders and the lower ends of all of the spreaders connected to their various points of securement to the boat hull and tensioned in the usual way.

Since the spreaders 12*a* and 12*b* are supported by the very strong, rigid bar-like bracket 14 which extends all the way through the mast, they form very rigid structures for maintaining the tensioned shrouds S′ in their spread-apart condition. The through-the-mast bracket 14 also, of course, provides an extremely strong support for the upper ends of the tensioned shrouds S. Furthermore it does this without imparting any appreciable torque to the mast which might tend to bend or distort the mast walls.

As noted above, the spreaders 12*a* and 12*b* desirably have an airfoil-type exterior surface configuration so that they minimize wind resistance. Also, since the shroud terminals 34 are connected to bracket 14 at locations spaced from the mast M, there is minimum air turbulence at those points of connection, particularly since there are no shroud-accommodating openings in the mast as is the case with some prior comparable shroud systems.

It should be noted, however, that where wind resistance is not an important factor, the two keyhole-pocket pairs 28, 30 can be formed at the inboard ends of bracket segments 14*a* and 14*b* positioned inside mast M. In this event, a single keyhole 28 located on centerline 15 and having two oppositely-directed necks 28*a* can accommodate the two pockets 30 so as not to unduly weaken the bracket. An arrangement such as this is indicated in dotted lines at 28', 30' in FIG. 3. Also, of course, if the terminals 34 are located inside the mast, appropriate openings are required in the mast to accommodate the shrouds S. One such opening is shown in dotted lines at 18*a* in FIG. 3.

When it is desired to remove the shrouds S for one reason or another, it is only necessary to remove the fasteners 37 and slide the spreaders out beyond the keyholes 28 formed in the bracket 14. Then, following the detensioning of the shrouds by loosening the turnbuckles T, the upper ends of the shrouds can be detached from bracket 14 simply by lifting up the terminals 34 and sliding them out through their respective keyholes 28 in the direction of arrow A in FIG. 4. Of course, if desired, the whole assembly 10 can be removed from the mast by removing the spreaders from the bracket and sliding the bracket out of the mast.

It will be seen from the foregoing, then, that my mast shroud system provides an extremely strong upper support for standing rigging on a sailboat. Furthermore, the system permits the upper ends of the various shrouds and stays to be disconnected from the mast quickly and easily without requiring the disconnection of the lower ends of those lines. Indeed, the spreaders, and the bracket which both supports the spreaders and forms the tangs for the shrouds can be completely removed from the mast without requiring any special tools. Finally, the present system minimizes wind resistance in the area of the spreaders. Accordingly, the system should find wide application particularly on the larger racing boats.

It will thus be seen that the objects set forth above, among those made apparent from the preceding description, are efficiently attained. Also certain changes may be made in the above construction without departing from the scope of the invention. For example, the terminal heads 34*a* need not be entirely recessed under the spreaders if wind resistance is not a factor. Rather they can project above the spreaders through appropriate slots formed at the inboard ends of the spreaders above slots 42. Therefore, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A mast shroud system comprising

A. an elongate rigid bracket for interlocking reception in aligned openings in a boat mast so that the bracket ends extend an appreciable distance out from opposite sides of the mast and the bracket is fixed against rotation about its longitudinal axis, B. means defining a pair of terminal-receiving pockets in said bracket, said pockets being spaced apart on opposite sides of the transverse center line of the bracket, each pocket having an opening which extends entirely through the bracket so that a terminal secured to the end of a line can seat in the pocket with the line extending out of the pocket through said opening, C. a pair of tubular spreaders for telescopically engaging over the opposite ends of the bracket, and D. means for removably securing the telescoped spreaders to the bracket.

2. The shroud system defined in claim 1 and further including means defining one or more keyholes in said bracket, each keyhole being contiguous with a said pocket so that a terminal can be inserted through each keyhole and be slid over so as to seat in the contiguous pocket.

3. The shroud system defined in claim 1 wherein the spreaders engage over and conceal said pockets.

4. The shroud system defined in claim 1 and further including a terminal seated in a said pocket.

5. The shroud system defined in claim 1 wherein

A. the bracket is received in said mast openings, and

B. said spreaders are telescopically engaged over opposite ends of said bracket so that their inner ends abut said mast whereby to fix the lateral position of the bracket relative to the mast.

6. The shroud system defined in claim 5 and further including means defining one or more terminal-accepting keyholes in said bracket, each keyhole being contiguous with a said pocket so that a terminal can be inserted through said keyhole and be slid over so as to seat in the contiguous pocket.

7. The shroud system defined in claim 6 wherein

A. each pocket and its contiguous keyhole are positioned on said bracket outboard of said mast, and B. said spreaders engage over said keyholes and prevent said terminals from being slid from their pockets to the contiguous keyholes.

8. The shroud system defined in claim 6 wherein

A. there are two said pockets positioned on said bracket at locations inside said mast, and B. a single keyhole is formed in said bracket between said pockets which extends into both of said pockets.

9. The shroud system defined in claim 8 and further including a terminal seated in each of said pockets, each said terminal being connected to a line.

10. The shroud system defined in claim 9 and further including slots formed in the inboard ends of the spreaders opposite said bracket openings for accommodating either a terminal or the line connected thereto.

* * * * *